United States Patent [19]

Downey, Jr.

[11] Patent Number: 4,467,853

[45] Date of Patent: Aug. 28, 1984

[54] DOOR WITH GUIDE INSULATION AND WEATHERSTRIPPING

[75] Inventor: Robert C. Downey, Jr., Columbus, Ohio

[73] Assignee: Harsco Corporation, Camp Hill, Pa.

[21] Appl. No.: 409,872

[22] Filed: Aug. 20, 1982

[51] Int. Cl.[3] ..... E06B 7/098

[52] U.S. Cl. ..... 160/133; 160/41

[58] Field of Search ..... 160/41, 133, 201, 202, 160/232, 270, 271, 272, 209, 235, 230

[56] References Cited

U.S. PATENT DOCUMENTS

| | | | |
|---|---|---|---|
| 1,352,656 | 9/1920 | Cahill | 160/133 |
| 1,918,415 | 7/1933 | Miller | 160/133 |
| 2,749,582 | 6/1956 | Beck . | |
| 2,862,256 | 12/1958 | Stroup . | |
| 2,942,561 | 6/1960 | Chesire | 160/201 X |
| 3,076,499 | 2/1963 | Zoll et al. | 160/41 |
| 3,227,205 | 1/1966 | Crosswell . | |
| 3,339,619 | 9/1967 | Crosswell . | |
| 3,489,200 | 1/1970 | Recchione | 160/41 |
| 3,516,471 | 6/1970 | Harkins et al. . | |
| 3,665,997 | 5/1972 | Smith et al. | 160/41 |
| 3,732,913 | 5/1973 | Wrono | 160/133 |
| 4,037,639 | 7/1977 | Jones . | |
| 4,333,511 | 6/1982 | Johnston | 160/271 |

FOREIGN PATENT DOCUMENTS

| | | | |
|---|---|---|---|
| 614566 | 2/1961 | Canada | 160/209 |

*Primary Examiner*—Peter M. Caun
*Assistant Examiner*—Cherney S. Lieberman
*Attorney, Agent, or Firm*—Kerkam, Stowell, Kondracki & Clarke

[57] ABSTRACT

An insulation and weatherstripping arrangement and associated method for a rolling door includes an insulation supporting member to support a block of expanded polystyrene or similar insulation inside a vertically extending cavity disposed between a guide track and a wall. Most advantageously, metallic parts disposed on the inside of the door are thermally isolated from metallic parts disposed on the outside of the door. Additionally, inner and outer weatherstrips are used for further minimizing heat loss.

8 Claims, 8 Drawing Figures

DOOR WITH GUIDE INSULATION AND WEATHERSTRIPPING

BACKGROUND OF THE INVENTION

Cross-Reference to Related Application

The present application discloses and claims a guide track insulation and weather stripping arrangement and method for use with a door which may be constructed as disclosed and claimed in the present inventor's U.S. Pat. No. 4,436,136 issued on Mar. 13, 1984 and assigned to the assignee of the present invention. This patent is hereby incorporated by reference.

Field of the Invention

The present invention relates to insulation and weatherstripping for doors. More specifically, it relates to insulation and weatherstripping for a rolling door comprising a plurality of slats which pivot relative to each other and move along a vertically extending guide track.

Background of the Prior Art

The use of rolling doors is well known. Such doors may be designed for rolling the sections or slats into a so called "curtain coil" adjacent to the top of the door. Such rolling doors are used for truck unloading docks at warehouses or similar industrial facilities.

Such rolling doors often include a guide track mounted on a mounting flange extending out from the inside surface of a wall at the edge of the door jam. The vertically extending guide track is usually spaced from the inside surface of the wall such that clearance is provided for rolling the slats into a coil adjacent the top of the door. That is, if the guide track was immediately adjacent the inside wall, it would be hard to suitably roll the slats of the door into a coil without hitting the inside surface of the wall.

The vertically extending cavity which is disposed between the guide track and the inside surface of the wall is disadvantageous in that it often provides a low thermal resistance path for heat from the warehouse or similar industrial facility to flow to the outside of the door. A number of prior art patents disclose various insulation and/or weatherstripping arrangements for doors. In particular, the following patents are somewhat illustrative:

| U.S. Pat. No. | Inventor |
|---|---|
| 2,749,582 | Beck |
| 2,862,256 | Stroup |
| 3,076,499 | Zoll et al |
| 3,227,205 | Crosswell |
| 3,339,619 | Crosswell |
| 3,489,200 | Recchione |
| 3,516,471 | Harkins et al |
| 3,665,997 | Smith et al |
| 4,037,639 | Jones |

The Beck patent discloses a sectional door having a sealing strip 26 (see especially FIG. 4) between the door jam 10 and door 20.

The Stroup patent shows a sectional door having a seal composed of resilient material 36 (see especially FIG. 4) defining a cavity in which a body member 35 is disposed.

The Zoll et al patent discloses a metal rolling door having a guide track using a seal 73 for sealing the interface between the door and the track. An alternate embodiment as shown in FIG. 8, uses an L-shaped member 76 and seal 79 in combination with an angle iron 77 to further seal the interface between the door and the track.

The Crosswell U.S. Pat. No. 3,227,205 discloses a sectional door including seals 29 in FIG. 4 and 27 in FIG. 8. The seals are mounted on the door and/or guide track itself.

The Crosswell U.S. Pat. No. 3,339,619 discloses a similar arrangement to the Crosswell U.S. Pat. No. 3,227,205 and includes seals 10 in addition to seal 70 (see especially FIGS. 3 and 5). Further, a projecting strip 34 in FIGS. 3 and 5 is used for biasing the seals 10.

The Recchione patent discloses a rolling door including sealing strips 32 and 56 (see especially FIGS. 2 and 3.

The Harkins et al patent discloses a seal structure 38 (see especially FIGS. 3 and 4) including a cavity which deflates to allow the door to be rolled up or down.

The Smith et al patent discloses a door which includes foamed material 68 (see especially FIG. 3) used to insulate the door guide track area. The foamed material 68 is disposed within a side seal 18 which is adhered to the wall by an L-shaped bracket 20.

The Jones patent discloses an insulated barrier which includes a track 45 secured to a wall by strip 32 (see especially FIG. 7) which is made of foam plastic with adhesive on both sides.

Although prior art structures used for insulating doors have been generally useful, they have generally been subject to one or more several disadvantages. In particular, many of these designs simply include weather seals or strips which prevent direct air flow through the interface between the door and the door jam or associated guide track. Such doors do little to prevent heat loss by way of metallic parts which extend inside and outside of the door. Further, such prior art doors generally use nylon or polypropylene brush weather strips or rubber strips to provide the sealing function. Although these materials do adequately seal against air flow, the thermal resistance of such generally thin strips leaves great room for improvement.

Another disadvantage common to many prior art door sealing and/or insulation arrangements is the necessity for altering basic designs and/or the necessity of using complex constructions.

A further disadvantage is that many prior art arrangements are relatively difficult or time consuming to install.

Another disadvantage common to many prior art arrangements is that insulation is disposed where it is prone to be hit by equipment moving in or out of the door.

Yet another disadvantage is that some prior art constructions use insulation mounted so as to take up additional space. If the insulation extends out from the guide track inside a warehouse or extends on the outside into a loading dock area, valuable space may be wasted.

SUMMARY OF THE INVENTION

Accordingly, it is an object of the present invention to provide a novel and improved door having insulation and weatherstrips.

A further object is to provide a novel and improved method of assembly for a door insulation and weatherstripping arrangement.

A further object of the present invention is to provide an insulation and weatherstripping arrangement for doors which may be used without extensive redesign of doors which have previously been used.

Yet another object of the present invention is to provide a door insulation and weatherstripping arrangement wherein installation is relatively straight forward, yet the insulation is housed and secured to prevent damage to the insulation.

A still further object of the present invention is to provide an insulation and weatherstrip arrangement and associated method whereby the door has superior insulating properties adjacent its guide track.

These and other objects of the present invention which will become apparent as the description proceeds are realized by a door comprising a plurality of slats connected for relative pivoting between adjacent slats, the slats mounted for movement along a vertical guide track, the guide track mounted on a mounting flange projecting out from and inside surface of a wall and having a vertically extending cavity between the wall and the guide track and bounded by the mounting flange and insulation disposed in the vertically extending cavity, the insulation being in contact only with stationery surfaces. The door further includes an insulation supporting member bounding the vertically extending cavity opposite the mounting flange, the insulation supporting member extending between the wall and the guide track, the insulation supporting members supporting the insulation disposed within the vertically extending cavity. The insulation supporting member is fixed to the guide track by adhesive tape and is fixed to the wall. The door further includes an outer weatherstrip mounted on the insulation supporting member to seal between the door and the insulation supporting member and an inner weatherstrip mounted on the guide track to seal between the door and the guide track. The insulation supporting member is L-shaped in horizontal cross section. The door further includes a core disposed above of the door and the door is opened by moving the slats up the guide track to wrap around the core.

The method of the present invention is a method of insulating a rolling door having slats and which is opened by moving up a guide track to wrap around a core at the top of the door. The guide track is mounted on a mounting flange projecting out from the wall and having a vertically extending cavity between the wall and the guide track and bounded by the mounting flange, the steps comprising attaching insulation to an insulation supporting member, and attaching the insulation supporting member to the wall such that the insulation supporting member extends to the guide track and bounds the vertically extending cavity on a side opposite the mounting flange and the insulation is in contact only with stationery surfaces and is disposed within the vertically extending cavity. The method further includes the step of securing the insulation supporting member to the guide track, which step is accomplished by adhesively taping the insulation supporting member to the guide track. The insulation supporting member is L-shaped in horizontal cross section and the securing of the L-shaped insulation supporting member is accomplished by securing a surface of the L-shaped insulation supporting member to a parallel surface on the guide track. The method further includes the steps of mounting an outer weatherstrip and an inner weatherstrip for sealing against air flow.

BRIEF DESCRIPTION OF THE DRAWINGS

These and other features of the present invention and the attendant advantages will be readily apparent to those having ordinary skill in the art and the invention will be more easily understood from the following detailed description of the preferred embodiments of the present invention taken in conjunction with the accompanying drawings wherein like reference characters represent like parts through the several views.

DETAILED DESCRIPTION OF THE INVENTION

Door and Slat Construction

Figure 1:
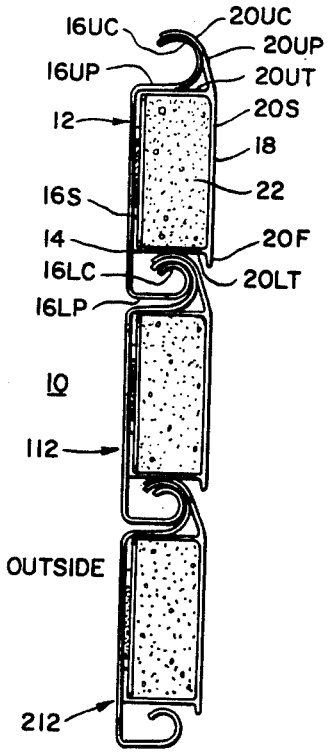
FIG. 1 shows a side view of a rolling door.

Turning initially to FIG. 1, there is shown a sideview of a door 10 comprising first, second, and third slat assemblies 12, 112, and 212. It will be readily appreciated that in actual practice such a door will usually have more than three slat assemblies.

Each of the slat assemblies 12, 112, 212 will be constructed identically. Accordingly, the details of slat assembly 12 will be discussed, it being understood that the other slat assemblies are constructed in likewise fashion. Slat assembly 12 includes a slat 14, preferably made of galvanized, pre-painted steel although other weather resistant metals may also be used. Slat 14 includes a generally planar side portion 16S, an upper planar portion 16UP perpendicular to the side portion 16S, an upper end curved portion 16UC, a lower end plane portion 16LP perpendicular to side portion 16S, and a lower end curved portion 16LL. As used throughout this application, generally planar shall be interpreted to mean that the side portion 16S (or other portion so described) defines a plane which might include decorative ridges, molding, or other slight variations from a plane. The slat as shown in slat No. 14 sold by the Kinnear Division of Harsco Corporation, assignee of the present invention, and is described at page 5 of Kinner bulletin No. 219, "Rolling doors and grills".

Slat assembly 12 further includes an extruded insulation cover 18 preferably made of rigid polyvinylchloride (PVC). Insulation cover piece 18 includes a generally planar side portion 20S and, separated from side portion 20S by an upper planar portion 20UP, is an upper end curved portion 20UC disposed at least partially around the upper end curved portion 16UC of the slat 14. Insulation cover piece 18 further includes a generally planar upper end transverse portion 20UT extending perpendicularly from the side portion 20S to the side portion 16S of the slat 14 and a generally planar lower and transverse portion extending perpendicularly from the side portion 20S to side portion 16S of the slat 14. The side portion 20S is parallel to side portion 16S of slat 14.

By making upper curved portion 20UC and upper transverse portion 20UT of insulation cover 18 accommodate upper curved portion 16UC and upper planar portion 16UP of slat 14 in the manner shown, the insulation cover 18 will by strongly secured to slat 14. Lower transverse portion 20LT will likewise help insulation cover 18 resist being accidentally pulled off slat 14.

Insulation 22, which may be expanded polystyrene foam, fiberglass or urethane foamed in place, is disposed in the cavity between the side portion 16S of slat 14 and the side portion 20S of the insulation cover 18. Instead of foaming in place, the insulation may alternately be inserted in block form as discussed below. The cavity having insulation 22 is further bounded by the upper transverse portion 20UT and the lower transverse portion 20LT.

As shown in FIG. 1, the upper and lower curved portions 16UC and 16LL of slat 14 and upper curved portion 20UC are disposed vertically in line with the insulation containing cavity. Vertically in line refers to above and below the cavity when the slat assembly 12 is disposed in a vertical position as when door 10 is closed.

Continuing to view FIG. 1, but also considering the exploded view of FIG. 2 and the perspective of FIG. 3, the details of the interface between insulation 22 and side portion 16S of slat 14 will be discussed. Adhesive 26 is used to secure a clip 24A, preferably made of steel or other metal, to the interior surface of side portion of 16S of slat 14. It will be readily appreciated that side portion 16S has an interior surface facing towards insulation 22 and an exterior surface facing away from the insulation. The clip 24A will hold the insulation cover 18 to the slat 14 by reason of the upper and lower lip 20UL and 20LL respectively extending perpendicularly at the ends of upper and lower transverse portion 20UT and 20LT.

Figure 4:
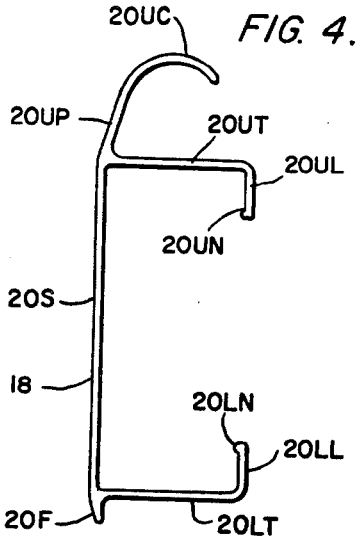
FIG. 4 shows a side view of an insulation cover for use with a rolling door.

Continuing to view the previous figures and also considering FIG. 4, which shows a side view of the insulation cover 18 of the present invention, the details of the extruded PVC insulation cover 18 will be discussed. In order to properly accommodate the different thermal expansion of the insulation 22 and the steel or metallic slat 14, no adhesion bonds are made between the insulation 22 and the interior surface of side portion 16S of slat 14. Instead, the insulation 22 is compressed fit and steel clip 24A is used to hold the cover 18 to the slat 14. Lips 20UL and 2LL on the insulation cover 18 include upper and lower nibs 20UN and 20LN such that steel clip 24 may move relative to the upper and lower lips 20UL and 20LL to minimize stress caused by the differing coefficients of thermal expansion of the insulation 22, PVC insulation cover 18, and steel slat 14.

Figure 2:
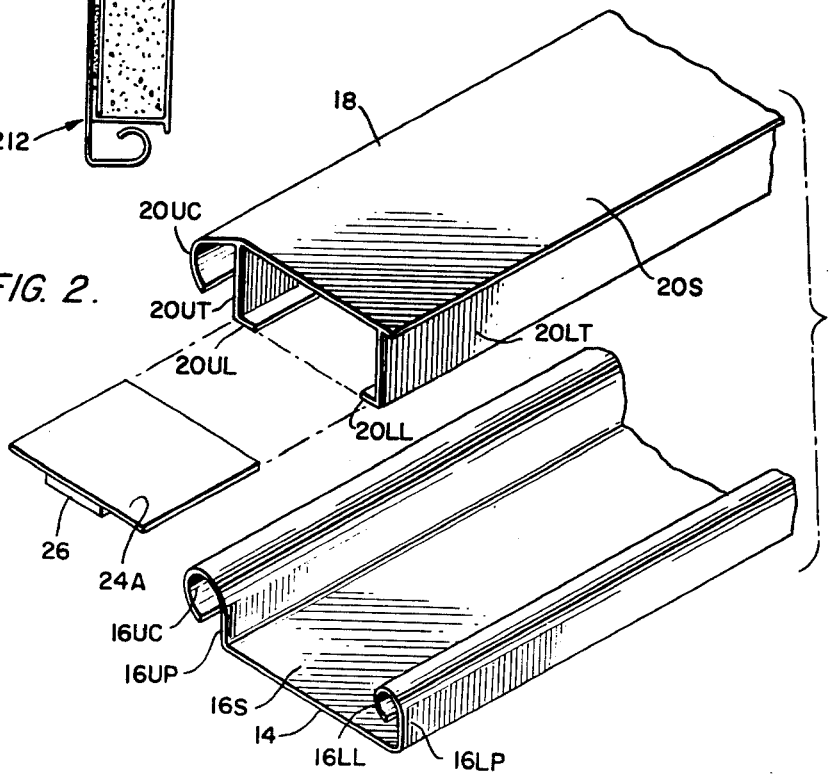
FIG. 2 shows an exploded view of a single door section or slat assembly of the door of FIG. 1.

Flange 20F may extend below side portion 20S at an angle of 10° (FIG. 4) or may simply be planar with 20S (FIGS. 1 and 2). In either case, flange 20F may function as a stop to prevent slat assembly 12 from being rotated too far clockwise (FIG. 1) relative to slat assembly 112. Lower planar portion 16LP and upper planar portion 16UP will serve as stops to prevent counterclockwise rotation (FIG. 1) of one slat assembly relative to another.

It should be noted that steel clip 24A is preferably one of a number of steel clips including also 24B and 24C which may be placed along the width of the slat assemblies such as 12. This will secure the insulation cover 18 to the slat 14 at various points along the length. In addition, in order to prevent the insulation cover 18 from sliding lengthwise to the slat 14, it is preferable to have the center clip 24B, shown with the insulation cover 18 and insulation 22 broken away in FIG. 3, adhered to the upper and/or lower lips 20UL and 20LL as well as being adhered to the interior surface of side portion of slat 14. Inasmuch as the steel clips 24A and 24C are adhered only to the steel slat 14, the insulation cover 18 may flex relative to the slat 14 as when the insulation expands all along the length of the interface except at center clip 24B.

Figure 3:
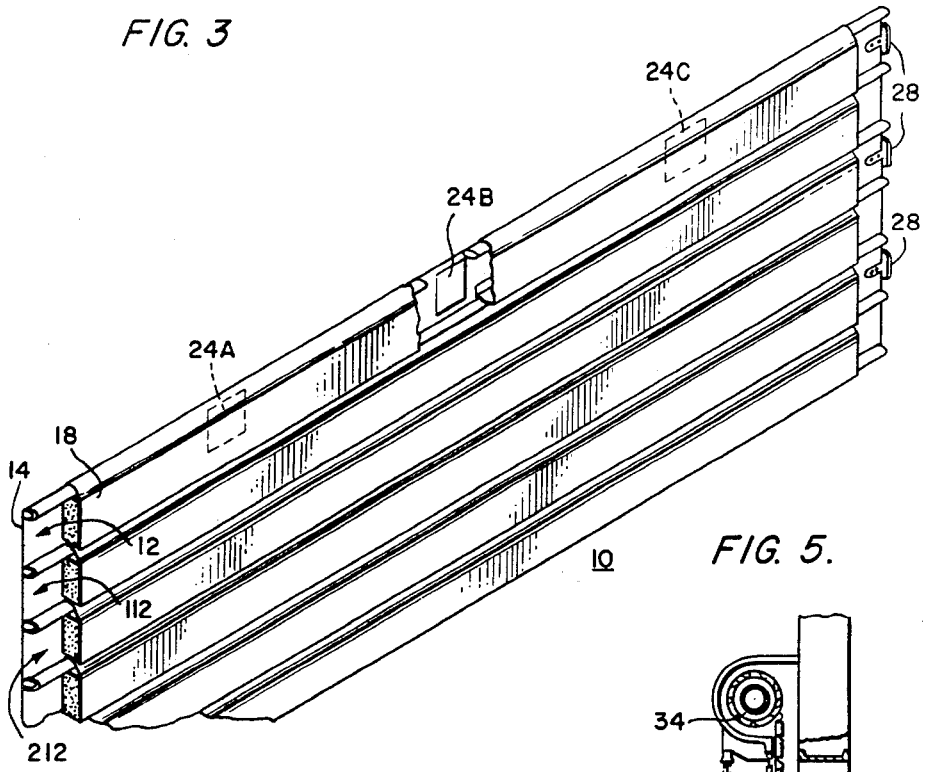
FIG. 3 shows a perspective view of the rolling door of FIG. 1.
Figure 5:
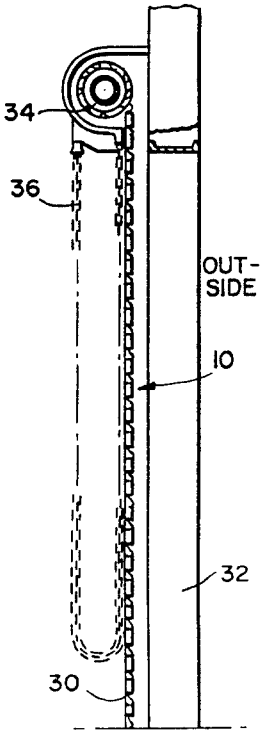
FIG. 5 shows a simplified side view illustrating the track assembly of the rolling door.
Figure 6:
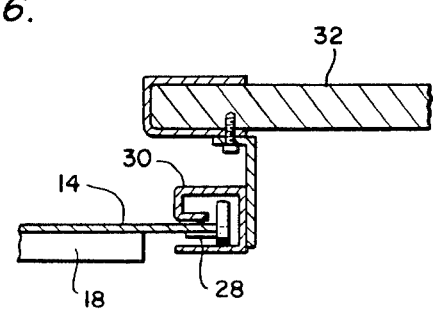
FIG. 6 shows a simplified cross-sectional view of the guide track of the rolling door.

Considering now FIGS. 3, 5, and 6, the movement of door 10 will presently be discussed. As shown in FIG. 3, every other slat assembly may include an end lock 28 which may be used to secure the door 10 to a guide track 30. Alternately, each slat assembly 12 could include an end lock 28 at both ends. For simplicity, no end locks 28 are shown at the left side of FIG. 3, although in actual practice the end locks would be disposed at both ends of the door 10. FIG. 6 shows a cross-sectional view looking directly down towards a wall 32 with a guide track 30 mounted thereupon. The end lock 28 which may be riveted to slat 14 cooperates with track 30 in a manner well known in the art. As shown in FIG. 5, the door 10 may move up guide track 30 to a coiled position around core 34 by manual operation of chain 36 or, alternately, by using a motor (not shown) to drive core 34. The details of the guide track 30, core 34, and chain 36 need not be discussed in detail, it being noted that these features are well known in the art. The details of door 10 are, of course, not visible in FIG. 5. However, it should be readily appreciated that the structure of applicant's door allows one to use these heretofore known components for an insulated door without requiring any adaptions to the guide track, core, and associated parts.

The method of assembling the insulated slat will presently be discussed. The portions 20UT and 20LT of insulation cover 18 are spread apart such that lips 20UL and 20LL may be cleared by insulation 22 which is inserted from the back (e.g. opposite 20S) into the cavity bounded by side portion 20S, upper transverse 20UT, lower transverse portion 20Ul, upper lip 20UL, and lower lip 20LL. The insulation cover 18 is preferably an extrusion of PVC and is sufficiently flexible to allow this spreading. The steel clips 24A, 24B, and 24C are likewise inserted by spreading portions 20UT and 20LT and lips 20UL and 20LL. The insulation 22 and steel clips 24A, 24B and 24C are compression fit into the cavity. Either before or after the insertion of steel clips 24A, 24B, and 24C, adhesive 26, which is preferably a thermoplastic synthetic rubber base double-sided adhesive sheet or tape, is mounted to the steel clips. If the center clip 24B is to be bound to insulation cover 18, the adhesive tape 26 may be placed vertically on the center clip 24B to adhere to lips 20UL and 20LL upon insertion of the clip 24B into the insulation cover 18.

The insulation cover 18, insulation 22, adhesive 26, and steel clips 24A, 24B, and 24C together comprise an insulation cover assembly. Release paper (not shown) may be used on the adhesive tape 26 to keep it from bonding prior to its bonding to slat 14.

The insulation cover assembly may be snapped onto the slat 14 with portion 20UC of insulation cover 18 pushed over and snapped to curved portion 16UC. This may be done from the interior surface of side portion 16S of slat 14 without removing the slat 14 from the track 30. The insulation cover assembly may be slid sideways until properly placed horizontally in the slat 14. Insulation cover 18 and assembly may then be rotated up (20UC rotating) about 16UC whereupon the release paper (not shown) may be removed from the adhesive tape 26 and the insulation cover assembly pushed towards the slat 14 to complete the assembly by bonding clips 24A, 24B, and 24C to slat 14.

Guide Insulation and Weatherstripping Arrangement

Figure 7:
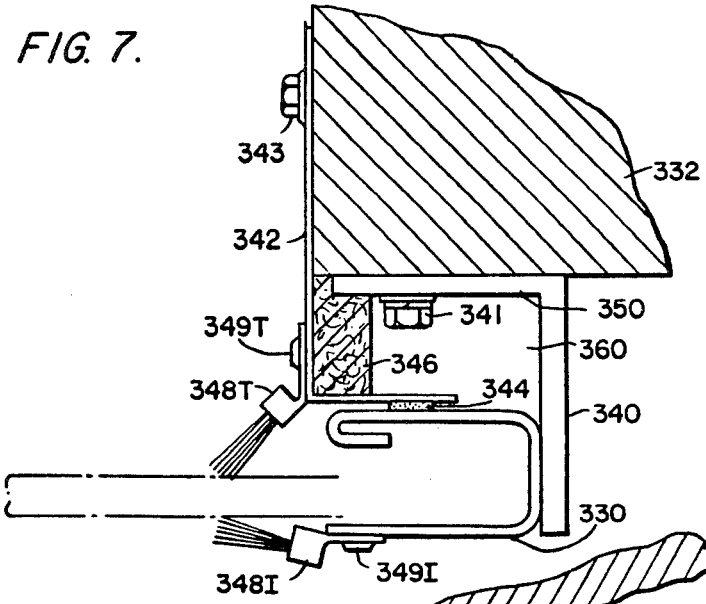
FIG. 7 shows a cross-section view taken along a horizontal plane of a guide insulation and weatherstripping arrangement according to the present invention.
Figure 8:
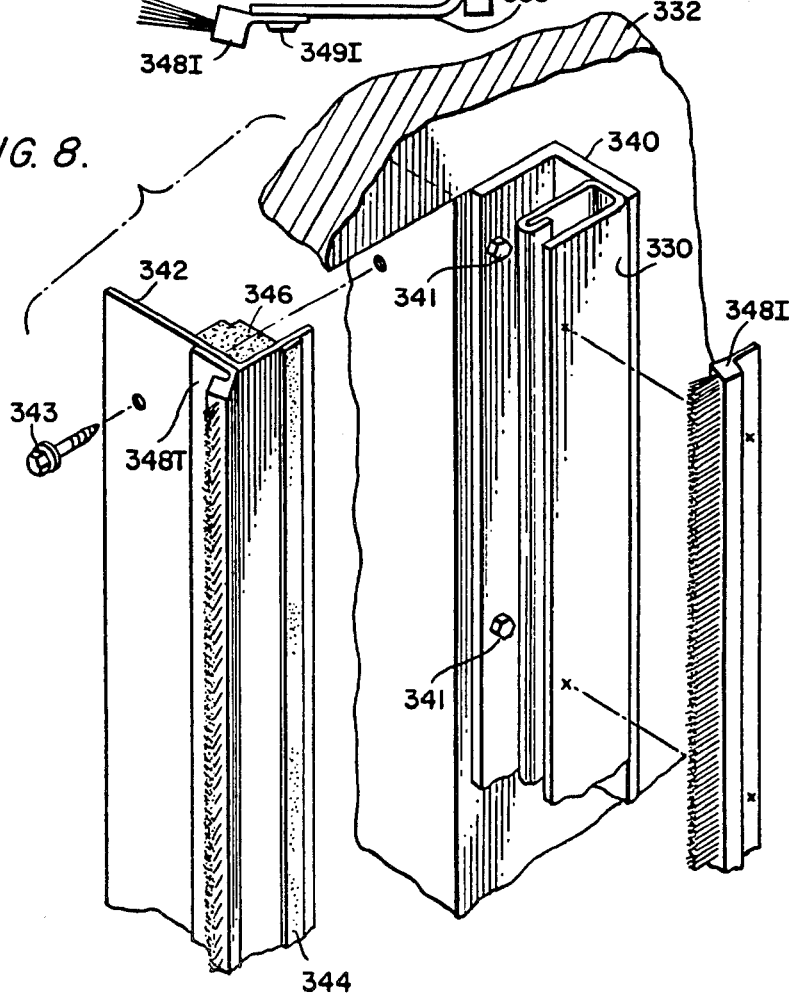
FIG. 8 shows an exploded perspective in partial break-away of parts of the guide insulation and weatherstripping arrangement according to the present invention.

Having described the insulated door slat construction of the inventor's referenced U.S. patent patent, a guide insulation and weatherstripping arrangement according to the present invention will be discussed with reference to FIGS. 7 and 8. FIG. 7 shows a cross-sectional view taken along a horizontal plane of a guide track insulation and weatherstripping arrangement according to the present invention. FIG. 8 shows an exploded perspective view of the guide insulation and weatherstripping arrangement according to the present invention. The guide track arrangement includes a guide track 330 mounted on a mounting flange 340 of mounting piece 350. Mounting piece 350 is in turn attached by bolts 341 to wall 332 in a manner essentially similar to that shown for the FIG. 6 guide track arrangement. As will most readily be noticed in FIG. 7, a vertically extending cavity 360 is disposed between the wall 332 and the guide track 330 and is further bounded by the mounting flange 340. The necessity for having this cavity 360 will be apparent by briefly referring back to FIG. 5. In particular, as the door slats of door 10 are rolled around the core 34, they increase in diameter and, therefore, require some clearance between the guide track 30 and wall 32 of FIG. 5 (guide track 330 and wall 332 of FIG. 7). In other words, the vertically extending cavity 360 is necessary to allow the door to be rolled up on core 34. However, this vertically extending cavity 360 provides a low thermal resistance path for heat inside the warehouse or similar industrial facility to escape.

In order to minimize this heat loss, the present invention uses an insulation supporting number 342 which is L-shaped in horizontal cross-section. The insulation supporting member 342 is secured to the wall 332 by screws 343 and is fixed to the guide track 330 by adhesive tape 344. Adhesive tape 344 is preferably a thermal plastic synthetic rubber base double sided adhesive sheet or tape such as butyl tape. The insulation supporting member 342 bounds the side of the vertically extending cavity 360 opposite the mounting flange 340. Further, the insulation supporting member 342 supports a block of expanded polystyrene insulation 346 within the vertically extending cavity. Adhesive (not shown) adheres the insulation 346 to the member 342. As shown in FIG. 7, the insulation 346 may simply fill a portion of the cavity 360. Alternately, the insulation 346 could extend substantially throughout the cavity 360 in which case it would include holes for accommodating the heads of bolts 341. A further option would be to include a separate piece or block of insulation at the intersection of the two legs of L-shaped mounting piece 350 of which mounting flange 340 is a part. Also, the bolts 341 could be disposed outside of the vertical extending cavity 360 by having the mounting piece 350 oriented differently. That is, instead of extending up and turning left as shown in FIG. 7, the mounting piece 350 could extend up along mounting flange 340 and turn right (e.g., away from cavity 360) for attachment to the wall 332. In this case, the insulation block 346 could be disposed completely throughout the vertically extending cavity 360 without hindrance with the bolts 341.

An outer weatherstrip 348T is mounted to the insulation supporting member 342 as by pop rivets 349T (not shown in FIG. 8). An inner weatherstrip 348I is mounted on the guide track 330 by pop rivets 349I (shown in FIG. 7 only with holes for pop rivets shown in FIG. 8) and functions to seal between the door and the guide track. A door is partially shown in phantom line between weatherstrips 348T and 348I in FIG. 7.

Most advantageously, the insulation 346 is disposed within the cavity 360 such that it is in contact only with stationery surfaces. That is, unlike mere seals which are generally thin to allow sliding of one surface along the seal, the insulation 346 is not in contact with any moving surfaces. Accordingly, the insulation 346 may be thicker and made of better insulative materials than is common for simple seals. Additionally, the insulation supporting member 342, which may be made of galvinized, pre-painted steel will be separated from the metallic guide track 330 and the metallic mounting flange 340. In particular, insulation 346 serves to thermally isolate insulation supporting member 342 from the mounting flange 350. Adhesive tape 344 tends to minimize heat flow or thermal transfer between the guide track 330 and the insulation supporting member 342.

The assembly of the guide track insulation and weatherstripping arrangement will presently be discussed. The insulation 346 may initially be attached to the insulation supporting member 342. The insulation supporting member 342 is then attached to the wall 332 such that the insulation supporting member 342 extends to the guide track 330 and bounds the vertically extending cavity 360 on a side opposite the mounting flange 340, the insulation being in contact only with stationery surfaces. The insulation supporting member 342 is secured to the guide track 330 by adhesive tape 344. As shown in FIG. 7, the adhesive tape secures a surface of the L-shaped insulation supporting member 342 to a parallel surface of the guide track 330. The outer weatherstrip 348T and the inner weatherstrip 348I may be respectively mounted on the insulation supporting member 342 and the guide trck 330. Alternately, the outer and inner weatherstrips 348T and 348I may be mounted prior to the mounting of the insulation supporting member 342 on to the wall 332. The weatherstrips 348T and 348I, which may be mounted by pop riveting, are commonly manufactured nylon or polypropylene brush weatherstrips.

As readily apparent from FIG. 7, the insulation supporting member 342 is L-shaped in horizontal corss-section with two legs, a long leg parallel and attached (by bolts 343) to an opening surface of the wall 332, whereas the other leg is parallel and attached (by adhesive tape 343) to a surface of the guide track 340. The opening surface defines the door opening, whereas the surface of the guide track 330 to which the leg is attached to parallel to the inside surface of the wall 332.

Most advantageously, the weatherstripping and guide insulation arrangement of the present invention will be used in conjunction with an insulated door as heretofore described, although other insulated doors or even noninsulated doors could be used.

It will readily appreciated that although the description presented with respect to FIG. 7 and FIG. 8 relate to one guide track, in actual practice a rolling door would include a guide track at each side. Accordingly, the insulation and weatherstripping arrangement would be the same at either side. Additionally, it will be readily appreciated that, although the use of FIG. 7 and FIG. 8 present the insulation supporting member 342, weatherstrips 348T and 348I, guide track 330, and guide track mounting flange 340 as each constituting a single and separate piece, alternatives will be readily apparent. For example, any of these components may be two or more vertically aligned pieces. If the door is designed to be 10 feet high, quite obviously two 5 feet lengths of weatherstripping, insulation supporting members, etc., could be used. Further, the insulation supporting members 342, guide track 330, and/or mounting piece 340 could be combined and made as a single piece.

Although specific materials and structures have been disclosed in the present application, it is to be appreciated that these are four illustrative purposes. Numerous modifications and adaptations will be readily apparent to those of ordinary skill in the art. Accordingly, the scope of the present invention should be determined with reference to the appended claims.

What is claimed is:

1. A door comprising a plurality of slats connected for relative pivoting between adjacent slats, said slats mounted for movement along a vertical guide track, said guide track mounted on a mounting flange projecting out from an inside surface of a wall and having a vertically extending cavity between said inside surface of said wall and said guide track and bounded by said mounting flange; and insulation disposed in said vertically extending cavity, and insulation being in contact only with stationary surfaces, and further comprising an insulation supporting member bounding said vertically extending cavity opposite said mounting flange, said insulation supporting member mounted to an opening surface of said wall, said opening surface defining an opening, and extending between said wall and said guide track, said insulation supporting member supporting said insulation disposed within said vertically extending cavity, and wherein said insulation supporting member is L-shaped in horizontal cross-section with two legs, one leg parallel and attached to said opening surface of said wall, the other leg parallel and attached to a surface of said guide track, said surface of said guide track being parallel to said inside surface of said wall.

2. The door of claim 1 wherein said insulation supporting member is fixed to said guide track by adhesive tape.

3. The door of claim 1 further comprising an outer weatherstrip mounted to said insulation supporting member to seal between said door and said insulation supporting member.

4. The door of claim 3 further comprising an inner weatherstrip mounted on said guide track to seal between said door and said guide track.

5. The door of claim 1 wherein said insulation supporting member is separated from said mounting flange to minimize thermal transfer therebetween.

6. The door of claim 1 wherein said insulation is discrete from any insulation external to said vertically extending cavity.

7. The door of claim 1 further comprising a core disposed above said door and wherein said door is opened by moving said slats up said guide track to wrap around said core.

8. The door of claim 1 wherein each of said slats includes a generally planar side portion, an upper end curved portion, and a lower end curved portion; and further comprising a plurality of insulation cover pieces, each insulation cover piece attached to a corresponding slat and having a generally planar side portion and an upper end curved portion disposed at least partially around said upper end curved portion of said corresponding slat, and insulation disposed in a cavity between said side portion of each insulation cover piece and said side portion of corresponding slat, said insulation cover piece further comprising a generally planar upper end transverse portion extending from said side portion of said insulation cover to said side portion of said slat, and a generally planar lower end transverse portion extending from said side portion of said insulation cover to said side portion of said slat.

* * * * *